US006837756B2

(12) United States Patent
Swearingen et al.

(10) Patent No.: US 6,837,756 B2
(45) Date of Patent: Jan. 4, 2005

(54) RADIALLY RESILIENT ELECTRICAL CONNECTOR AND METHOD OF MAKING THE SAME

(75) Inventors: Dean D. Swearingen, deceased, late of Clinton Township, MI (US); by Judith J. Swearingen, legal representative, Clinton Township, MI (US)

(73) Assignee: Amphenol Corporation, Wallington, CT (US)

( * ) Notice: Subject to any disclaimer, the term of this patent is extended or adjusted under 35 U.S.C. 154(b) by 0 days.

(21) Appl. No.: 10/264,806

(22) Filed: Oct. 4, 2002

(65) Prior Publication Data

US 2003/0068931 A1 Apr. 10, 2003

Related U.S. Application Data

(60) Provisional application No. 60/330,188, filed on Oct. 18, 2001, and provisional application No. 60/327,475, filed on Oct. 5, 2001.

(51) Int. Cl.[7] ..... H01R 13/187

(52) U.S. Cl. ..... 439/843; 439/851

(58) Field of Search ..... 439/843, 842, 439/851, 844, 846

(56) References Cited

U.S. PATENT DOCUMENTS

| | | | | |
|---|---|---|---|---|
| 1,833,145 A | | 11/1931 | Wilhelm | |
| 2,450,529 A | * | 10/1948 | Sprigg | 489/876 |
| 3,396,364 A | | 8/1968 | Bonhomme | |
| 3,470,527 A | | 9/1969 | Bonhomme | |
| 3,517,374 A | | 6/1970 | Bonhomme | |
| 3,557,428 A | | 1/1971 | Bonhomme | 29/203 |
| 3,626,361 A | | 12/1971 | Bonhomme | |
| 3,641,483 A | | 2/1972 | Bonhomme | |
| 3,686,622 A | | 8/1972 | Bonhomme | |
| 3,808,589 A | | 4/1974 | Bonhomme | |
| 3,858,962 A | | 1/1975 | Bonhomme | |
| 4,128,293 A | | 12/1978 | Paoli | |
| 4,175,821 A | | 11/1979 | Hunter | |
| 4,203,647 A | | 5/1980 | Bonhomme | |
| 4,657,335 A | | 4/1987 | Koch et al. | |
| 4,720,157 A | | 1/1988 | Nestor et al. | 438/851 |
| 4,734,063 A | | 3/1988 | Koch et al. | 439/844 |
| 4,750,897 A | * | 6/1988 | Neidecker | 439/825 |
| 4,840,587 A | | 6/1989 | Lancella | 439/851 |
| 4,902,235 A | | 2/1990 | Tonooka | 439/72 |
| 5,033,982 A | | 7/1991 | Lucas | 439/750 |
| 5,108,318 A | | 4/1992 | Sakurai et al. | 439/744 |
| 5,147,229 A | | 9/1992 | Nestor | 439/843 |
| 5,199,909 A | | 4/1993 | Molitor et al. | 439/843 |
| 5,203,813 A | * | 4/1993 | Fitzsimmons et al. | 29/876 |
| 5,326,289 A | | 7/1994 | Leisey | 439/851 |
| 5,378,552 A | | 1/1995 | Dixon et al. | 429/91 |
| 5,416,286 A | | 5/1995 | Dixon et al. | 200/16 |
| 5,511,307 A | | 4/1996 | Reiersgaard et al. | 29/863 |
| 5,607,328 A | | 3/1997 | Joly | 439/852 |
| 5,662,497 A | | 9/1997 | Reilly | 439/627 |
| 5,735,716 A | | 4/1998 | Bilezikjian | 439/843 |
| 6,102,746 A | * | 8/2000 | Nania et al. | 439/675 |
| 6,250,974 B1 | | 6/2001 | Kerek | 439/842 |
| 6,482,049 B1 | * | 11/2002 | Swearingen | 439/843 |
| 6,520,998 B1 | * | 2/2003 | Scholler et al. | 439/851 |
| 2002/0037674 A1 | * | 3/2002 | LaCoy | 439/851 |

FOREIGN PATENT DOCUMENTS

| | | |
|---|---|---|
| GB | 1136589 | 12/1968 |
| GB | 2065993 | 7/1981 |
| WO | WO 98/43321 | 10/1998 |

OTHER PUBLICATIONS

Hypertac Interconnect; FRB Connectron; Apr. 1999.

* cited by examiner

*Primary Examiner*—Hae Moon Hyeon
(74) *Attorney, Agent, or Firm*—Blank Rome LLP

(57) ABSTRACT

A radially resilient electrical connector includes a cylindrical sleeve with spaced notches at one end circumferentially offset from or axially aligned with spaced notches at an opposed second end. A contact member has ends on contact strips engaged with the notches at the ends of the sleeve to axially offset the ends of the contact strips from each other and to form each contact strip into a hyperbolic shape. The ends of the contact strips are fixedly mounted in the notches.

32 Claims, 5 Drawing Sheets

RADIALLY RESILIENT ELECTRICAL CONNECTOR AND METHOD OF MAKING THE SAME

CROSS REFERENCE TO CO-PENDING APPLICATION

This application claims the benefit of the Oct. 5, 2001 filing date of now abandoned U.S. Provisional Patent Application Ser. No. 60/327,475, and the benefit of the Oct. 18, 2001 filing date of now abandonded U.S. Provisional Patent Application Ser. No. 60/330,188, the contents of both of which are incorporated herein in their entirety.

BACKGROUND

The present invention relates, in general, to electrical connectors, and, more specifically, to radially resilient electrical sockets, also referred to as barrel terminals, in which a cylindrical electrical prong or pin is axially inserted into a socket whose interior surface is defined by a plurality of contact strips or wires mounted within a cylindrical sleeve and inclined between opposed ends.

Radially resilient electrical sockets or barrel terminals are a well known type of electrical connector as shown in U.S. Pat. Nos. 4,657,335 and 4,734,063, both assigned to the assignee of the present invention.

In such electrical sockets or barrel terminals, a generally rectangular stamping or sheet is formed with two transversely extending webs spaced inwardly from and parallel to opposite end edges of the sheet. Between the inward side edges of the transverse webs, a plurality of uniformly spaced, parallel slots are formed to define a plurality of uniformly spaced, parallel, longitudinally extending strips which are joined at opposite ends to the inward side edges of both transverse webs. Other longitudinally extending slots are coaxially formed in the sheet and extend inwardly from the end edges of the blank to the outer side edges of the transverse webs to form a plurality of uniformly spaced, longitudinally extending tabs projecting outwardly from each transverse web.

The blank or sheet is then formed into a cylinder with the longitudinal strips extending parallel to the axis of the now cylindrical sheet. A closely fitting cylindrical sleeve is slipped coaxially around the outer periphery of the cylindrical blank, and extends axially substantially between the outer side edges of the transverse webs. The tabs at each end of the blank are then bent outwardly across end edges of the sleeve into radially extending relationship to the sleeve.

A relatively tight-fitting annular collar or outer barrel is then axially advanced against the radially projecting tabs at one end of the sleeve and slipped over the one end of the sleeve driving the tabs at that end of the sleeve downwardly into face-to-face engagement with the outer surface of the one end of the sleeve. The fit of the annular collar to the sleeve is chosen so that the end of the cylindrical blank at which the collar is located is fixedly clamped to the sleeve against both axial or rotary movement relative to the sleeve.

A tool typically having an annular array of uniformly spaced, axially projecting teeth is then engaged with the radially projecting tabs at the opposite end of the sleeve. The teeth on the tool are located to project axially between the radially projecting tabs closely adjacent to the outer surface of the cylindrical sleeve. The tool is then rotated about the longitudinal axis of the cylindrical sleeve while the sleeve is held stationary to rotatably displace the engaged tabs approximately 15° to 45° from their original rotative orientation relative to the sleeve and the bent over tabs at the opposite end of the sleeve. The tool is then withdrawn and a second annular collar or outer barrel is force fitted over the tabs and the sleeve to fixedly locate the opposite end of the blank in a rotatably offset position established by the tool.

When completed, such an electrical socket has longitudinal strips extending generally along a straight line between the angularly offset locations adjacent the opposite ends of the cylindrical sleeve. The internal envelope cooperatively defined by the longitudinal strips is a surface of revolution coaxial to the axis of the cylindrical sleeve having equal maximum radii at the points where the strips are joined to the respective webs and a somewhat smaller radius midway of the length of the strips. The minimum radius, midway between the opposite ends of the strips, is selected to be slightly less than the radius of a cylindrical connector pin which is to be inserted into the barrel socket so that the insertion of the pin requires the individual longitudinal strips to stretch slightly longitudinally to firmly frictionally grip the pin when it is seated within the barrel socket.

To put it another way, because of the angular offset orientation of the opposed ends of each of the strips, each strip is spaced from the inner wall of the sleeve in a radial direction progressively reaching a maximum radial spacing with respect to the outer sleeve midway between the ends of the sleeve.

Such a radially resilient electrical barrel socket provides an effective electrical connector which provides secure engagement with an insertable pin; while still enabling easy manual withdrawal and insertion of the pin relative to the socket.

Other approaches to simplify the locking of the ends of the contact strips in the angularly offset position relative to the sleeve have also been devised. One such approach is the formation of axially extending grooves or splines in the interior of the sleeve. The grooves receive the ends of the contact strips of the contact member after one of the ends has been angularly offset relative to the other end to fixedly secure the ends of the contact strip in the desired angularly offset position without the need for outer mounting sleeves.

While the grooves or splines eliminate the need for outer sleeves to retain the ends of the contact strips in the angularly offset position relative to each other and to the sleeve, it is believed that further improvements could be made to a radially resilient electrical barrel socket to afford a simplified construction, and manufacturing sequence while still retaining the features of securely holding the ends of the contact strip in the angularly offset position without the need for outer end sleeves.

SUMMARY

The present invention is a method and apparatus for providing a radially resilient electrical connector. In one aspect, the invention is a method of manufacturing an electrical connector comprising the steps of: forming a cylindrical sleeve with first and second ends, forming alternating notches and projections on each of the first and second ends of the sleeve, forming a cylindrical contact member with a plurality of spaced contact strips extending between first and second ends, inserting the contact member into the sleeve with the first ends of the contact member engaging the notches at the first end of the cylindrical sleeve, angularly offsetting the second ends of the contact member from the first ends of the contact member, engaging the axially offset second ends of the contact members into the notches in the second end of the cylindrical sleeve and fixing the first and second ends of the contact member to the cylindrical sleeve.

The method also comprises the steps of flaring the second ends of the contact strips angularly outwardly to engage the second ends of the contact member in the notches in the cylindrical sleeve during the angular rotation of the second end of the contact member relative to the first end of the contact strips.

In another aspect, the method comprises the step of bending the first ends of the contact member substantially 90° with respect to an axial length of the contact member prior to insertion of the contact member into the sleeve.

The fixing step of the method uses mechanical joining of the projections and strip ends. In one aspect, the mechanical joining is accomplished by swaging. In yet another aspect, at least one of the projections is split into separate portion, each mechanically joined to adjacent strip ends.

In another aspect, the method further comprises the steps of forming the contact member as a one-piece contact blank with the plurality of spaced contacts strips having the first and second ends, integrally joining the first and second ends of the contact strips to respectively, transversely extending, first and second parallel webs, forming a plurality of groups of first and second tabs projecting from the first and second webs, respectively, and bending integral contact arms disposed between adjacent contact strips axially from the second tabs toward the first tabs.

In another aspect, an electrical connector is disclosed which includes a cylindrical sleeve with first and second ends, alternating notches and projections on each of the first and second ends of the sleeve, with the notches and projections on the first end of the sleeve being axially offset from the corresponding notches and projections on the second end of the sleeve, a cylindrical contact member with a plurality of spaced contact strips extending between the first and second ends, inserting the contact member into the sleeve with tabs at the first end of the contact member engaging the notches at the first end of the cylindrical sleeve, tabs at the second end of the contact member angularly offset the from tabs at the first end of the contact member, the axially offset tabs at the second end of the contact members engage with the notches in the second end of the cylindrical sleeve, and the tabs fixed on the first and second ends of the contact member to the cylindrical sleeve.

In another aspect, the connector includes an extension projecting axially from the second end of the sleeve, the extension formed into a cylindrical wire grip for receiving an electrically conductive member therein.

In yet another aspect, the connector includes extensions formed between each of the contact strips and extending axially from the second end of the sleeve, the contact arms mountable in a wire crimp terminal for connecting the arms and the integrally joined connector to an external electrically conductive member.

In one aspect the notches and projections on the first end of the sleeve being axially offset from the corresponding notches and projections on the second end of the sleeve.

In another aspect, the notches and projections at opposite ends of the sleeve are coaxially aligned, with the ends of the contact strips being fixed in non-axial, angularly offset notches to form the hyperbolic bend in the contact strips.

The electrical connector and method of manufacturing the same provides several advantages over previously devised, radially resilient electrical connectors. The present connector and method simplifies the inner connection of the interior grid with the outer sleeve. The direct joining of the tabs on the grid within alternating notches and projections on the ends of the sleeve eliminates the need for external collars previously employed to fixedly secure the tabs on the grid around the outer ends of the sleeve. Such direct joining also eliminates the formation of internal grooves or splines used alternatingly to receive the tabs at the ends of the contact member.

The aspect utilizing contact arms formed from the material initially disposed between adjacent contact strips reduces material waste and provides an enhanced electrical conductor at a lower cost. The contact arms can also extend the direct current path between an inner connecting pin or conductor to the grid in the sleeve.

BRIEF DESCRIPTION OF THE DRAWING

The various features, advantages, and other uses of the present invention will become more apparent by referring to the following detailed description and drawing in which.

DETAILED DESCRIPTION

Figure 1:
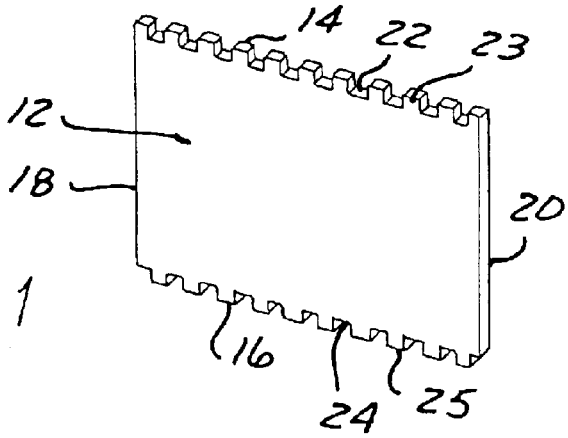
FIG. 1 is a perspective view of an outer sleeve used in the electrical connector of the present invention, with the sleeve shown in an expanded, precylindrically formed shape.

The present invention is an improved, radially resilient electrical connector 10 having a unique outer sleeve as described hereafter. In FIG. 1, the sleeve 12 is shown in an expanded, pre-cylindrically shaped form generally having a planar shape. The sheet 12 may be stamped or otherwise formed in the following configuration. The sheet 12 has opposed major side edges 14 and 16 and intervening minor side edges 18 and 20. Although the sheet 12 is described and illustrated herein as having a rectangular shape, it will be understood that the sheet 12 may also have a square configuration.

A plurality of apertures 22 and 24 are respectively formed along the major side edges 14 and 16. The apertures 22 and 24 preferably have a square edged, notch shape extending from an open end at the side edges 14 and 16, respectively, to an inner end of a predetermined depth and width. The apertures or notches 22 and 24 preferably have a square configuration as shown in FIG. 1. Projections 23 and 25 are formed between adjacent notches 22 and 24, respectively.

According to the unique feature of the present invention, the notches 22 are linearly offset from the notches 24. That is, each of the notches 22 on the side edge 14 of the sheet 12 are linearly aligned with one projection 25 formed between two notches 24 on the opposed side edge 16. Similarly, each notch 24 on the side edge 16 is aligned with one projection 23 on the side edge 14.

Figure 2:
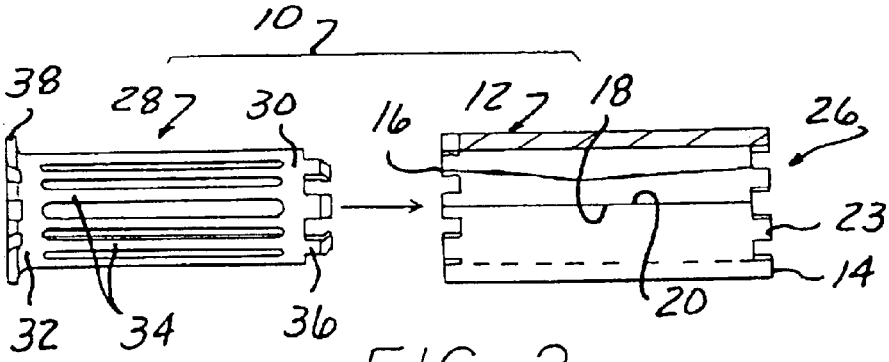
FIG. 2 is an exploded, partially cross sectioned, side elevational view showing the assembly of the sleeve and one aspect of a cylindrical blank have individual contact strips and end tabs.

In constructing the connector 10 of the present invention, the sheet 12 is formed-into a cylinder as shown in FIG. 2. The minor edges 18 and 20 are joined together by any suitable means, such as an interlocking projection and notch, a dovetail connection, welding, etc.

The sheet 12, which will now be referred to as a cylindrical sleeve 26, is slidable over or slidably receives a cylindrically formed grid 28 or contact member as shown in FIG. 2. The grid 28 is originally formed as a blank stamped in a generally rectangular configuration. The grid 28 includes a pair of spaced, parallel, transversely extending connecting webs 30 and 32. The webs 30 and 32 are integrally connected to each other by a plurality of uniformly spaced, parallel, longitudinally extending contact strips 34. Tabs 36 project axially from the web 30. Tabs 38 project axially from the opposed web 32.

The grid 28 and the sleeve 26 are preferably formed of a suitable electrically conductive material, such as copper or a beryllium copper alloy.

In a first assembly step, the tabs 38 projecting from the web 32 are bent to approximately a 90° angle with respect to the strips 34. Meanwhile, the tabs 36 extending from the opposed web 30 are flared radially outward at a smaller angle, such as approximately 30°.

Figure 3:
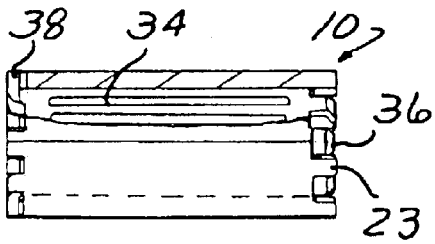
FIG. 3 is a partially cross sectioned, side elevational view of the assembled sleeve and blank shown in FIGS. 1 and 2.
Figure 4:
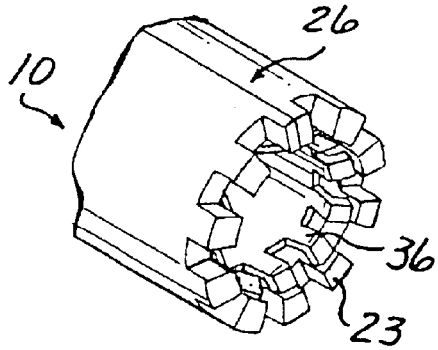
FIG. 4 is a partial, end perspective view of the assembled sleeve and blank shown in FIG. 3.

The grid 28 is then slidably inserted into the interior of the cylindrical sleeve 26. The outwardly flared tabs 36 temporarily bend inward to allow for the sliding insertion of the grid 28 into the sleeve 26. As shown in FIGS. 3 and 4, the grid 28 is inserted into the sleeve 26 until the tabs 38 slide into contact with the notches 24 in the side edge 16 of the sleeve 26. As shown in FIG. 4, the tabs 36 at the opposite end of the grid 28 are aligned with, under resilient force due to the angular outward bend, and engage the projections 23 along the side edge 14 of the sleeve 26.

Figure 5:
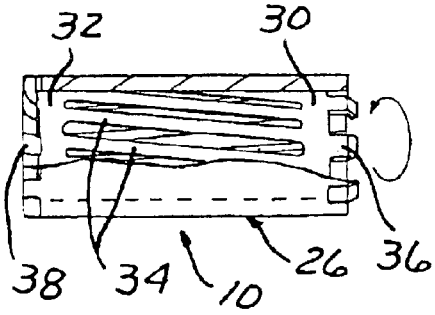
FIG. 5 is a partially cross sectioned, side elevational view showing the assembled sleeve and blank of FIGS. 1–4 in a subsequent assembly stage.

A tool, not shown, having a plurality of axially extending, circumferentially spaced fingers, for example, is then inserted into the interior of the sleeve 26 with the fingers interweaving with the notches between the tabs 36 on the grid 28. The tool is then rotated to impart an angular offset to the tabs 36 relative to the tabs 38 at the opposed end of the grid 28. Preferably, the angular offset is approximately 50° which brings each tab 36 into alignment with one of the notches 22 on the first side edge 14 of the sleeve 26. During this rotation, the tabs 36 will automatically snap into one of the notches 22, thereby locking the grid 28 in the sleeve 26 as shown in FIG. 5. The angular offset of the tabs 36 from the opposed tabs 38 causes the contact strips 34 to assume an angular position between the webs 30 and 32. The characteristics of the beryllium copper alloy, of which the grid 28 is preferably formed, is such that, although the alloy possesses some resiliency, the rotation imparted by the tool permanently sets the grid 28 in the rotated position.

The angular offset between the ends of the strips 34 causes each strip 34 to assume a hyperbolic shape between the opposed webs 30 and 32. An apex or center point of each strip 24 forms an annulus having a nominal diameter less than the pre-angular offset diameter of the interior of the strips 34. This diameter is nominally less than the diameter of an interconnecting pin which is to be inserted into the connector 10.

Figure 6:
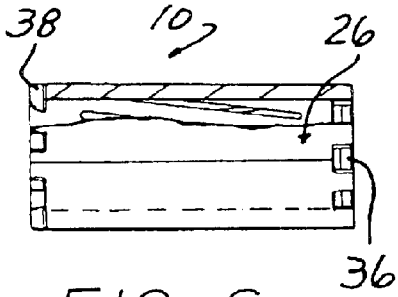
FIG. 6 is a partially cross sectioned, side elevational view showing the completely assembled sleeve and blank of FIGS. 1–5.
Figure 7:
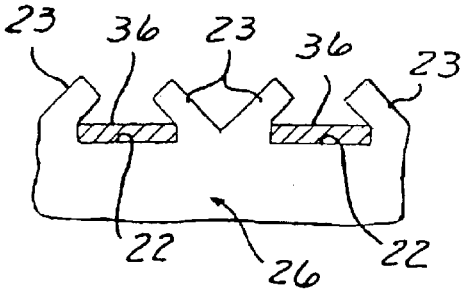
FIGS. 7 and 8 are enlarged, partially cross sectioned end elevational views showing the swaging of tabs on the end of the blank shown in FIG. 6 into the notches on the end of the sleeve.
Figure 8:
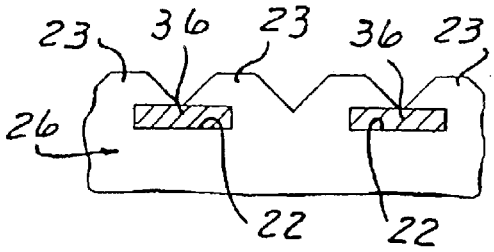

As shown in FIG. 6, and in greater detail in FIGS. 7 and 8, the tabs 36 and 38 are then fixedly secured to the sleeve 26 by suitable means, such as welding, bending, etc. FIGS. 7 and 8 show a preferred connection utilizing swaging. The projections 23 between adjacent notches 22 along the first side edge 14 as well as the projections 25 located between adjacent notches 24 on the opposed side edge 16 of the sleeve 26 are swaged under force over and into secure engagement with the tabs 36 and 38, respectively, disposed in the adjoining notches. In FIG. 7, the initial part of the swaging operation is depicted where the end portions of the projections 23 are partially bent over the tabs 36 disposed in adjacent notches 22. The same sequence occurs with the opposed projections 25 and the tabs 38 in the notches 24.

FIG. 8 depicts the completion of the swaging operation. The projections 23 and 25 may be initially notched during the stamping or forming of the sheet 12 to allow each projection 23, 25 to split into two portions which are swaged over adjacent tabs 36 or 38.

The connector 10 is now ready for mounting in a suitable holder or use element for connecting an insertable pin to the use element.

Figure 20:
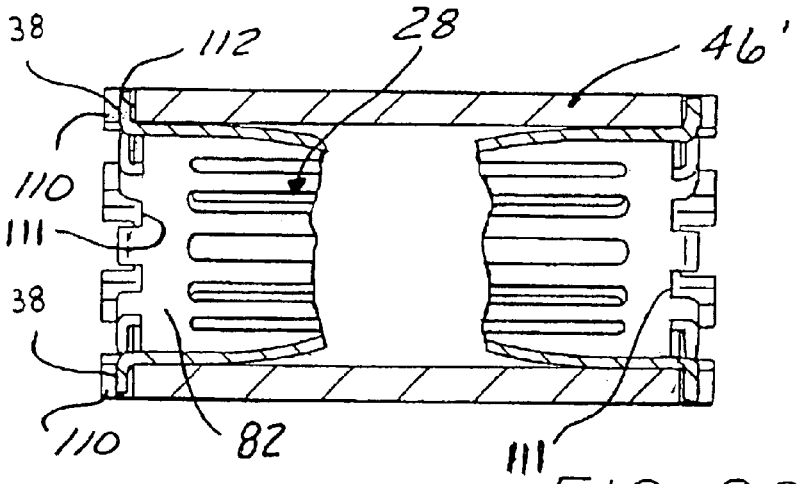
FIG. 20 is a longitudinal cross-sectional view showing an initial step in another aspect of the present connector.
Figure 21:
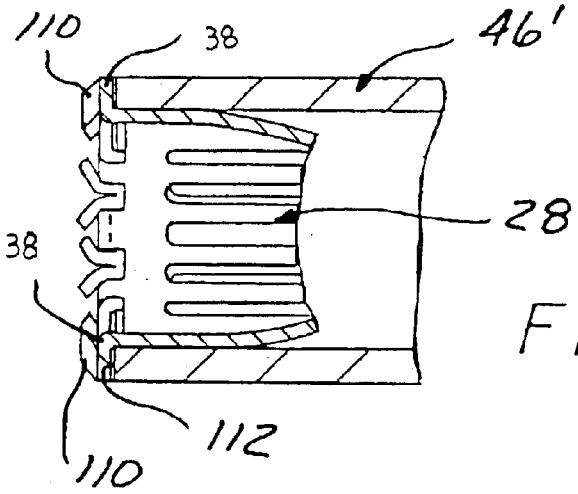
FIG. 21 is a partial, longitudinal cross-sectional view of the one completed end of the grid anchor shown in FIG. 14.
Figure 22:
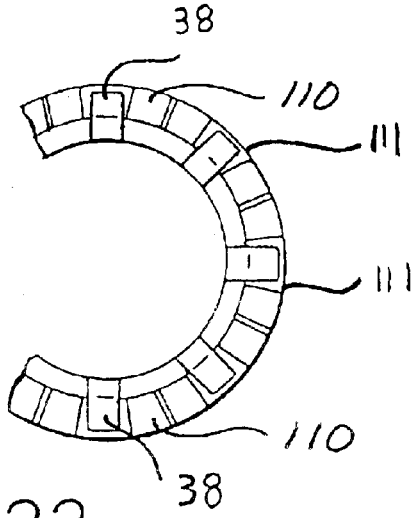
FIG. 22 is an end view of the completed external grid anchor shown in FIGS. 20 and 21.

Referring now to FIGS. 20 and 21, there is depicted another aspect of a connector according to the present invention. In this aspect, the external end of the sleeve 46' is provided by stamping or other forming methods with a plurality of axially extending fingers or lands 110 on at least one or both ends, which form circumferentially spaced slots 111 having an interior end 112. The slots 111 receive the radially outward bent tabs 38 on the grid 28 as shown in FIG. 20. Next, the metal of each finger 110 between the slots 111 and the face of the bent tabs 38 is split and upset or deformed over the tabs 38 to lock the tabs 38 in engagement with the internal wall 112 of each slot 111 on the sleeve 46' as shown in FIGS. 21 and 22. It will be understood that this mechanical interlock takes place first on one end and then after the angular offset is created between the opposite ends of the strips 38 of the grid 28, at the other end of the sleeve 46'.

If the grid 28 is formed of individual wires rather than web connected strips 34 the wires can be place diagonally end-to-end in the sleeve 46'. Tensioning is achieved by using a longer length wire which is bend to a hyperbolic shape during the swaging of the external ends as described above.

Figure 9:
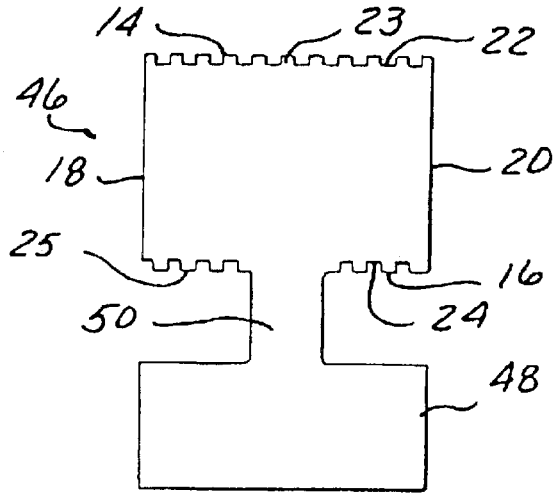
FIG. 9 is an expanded, precylindrical formed view of a sleeve and terminal according to an alternate aspect of the present invention.
Figure 10:
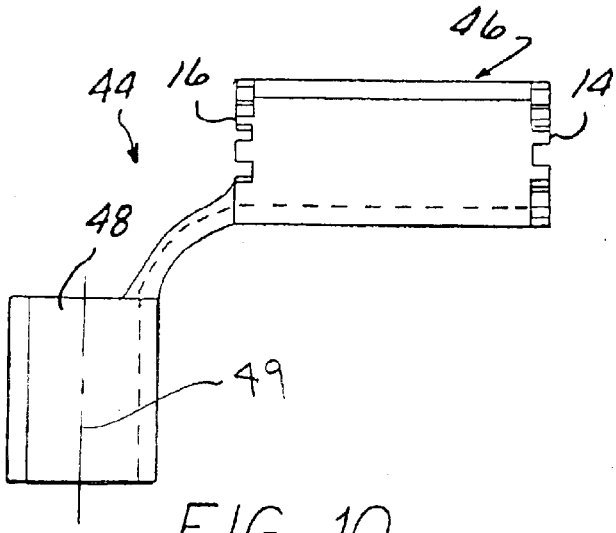
FIG. 10 is a side elevational view of the sleeve and terminal shown in FIG. 10, after the sleeve and terminal have been cylindrically shaped.

FIGS. 9 and 10 depict an alternate aspect of a sleeve 46 which includes an integral terminal, such as a wire crimp terminal 48. The cylindrical sleeve 46 is formed from a sheet, similar to sheet 12, except that a portion of the notches 24 and intervening projections 25 along the opposed side edge 16, generally at a central portion of the sleeve 46, are eliminated and replaced by a flange 50 which integrally connects the cylindrical sleeve 46 to the wire crimp terminal 48.

Figure 11:
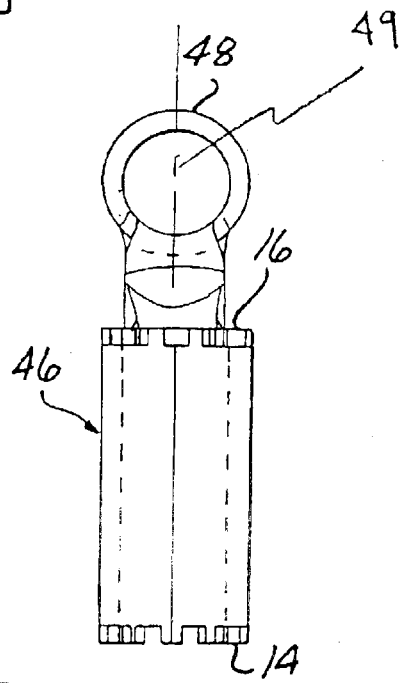
FIG. 11 is a plan elevational view of the sleeve and terminal shown in FIG. 10.
Figure 12:
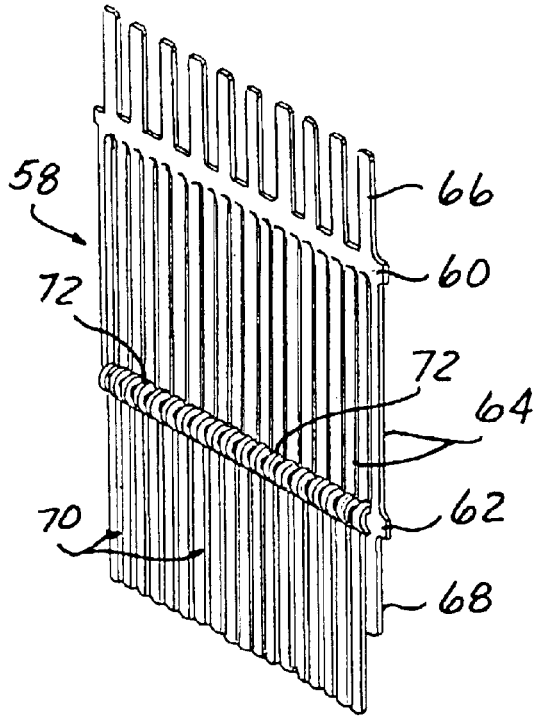
FIG. 12 is a perspective view of an alternate blank used in another aspect of an electrical connector of the present invention, with the blank shown in an expanded, precylindrically shaped form.
Figure 13:
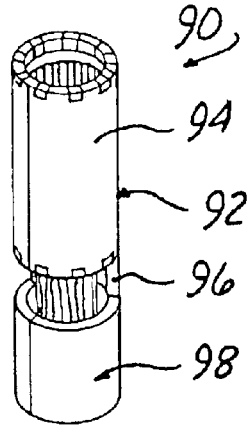
FIG. 13 is a perspective view of the blank of FIG. 12 in an outer cylindrical sleeve.
Figure 14:
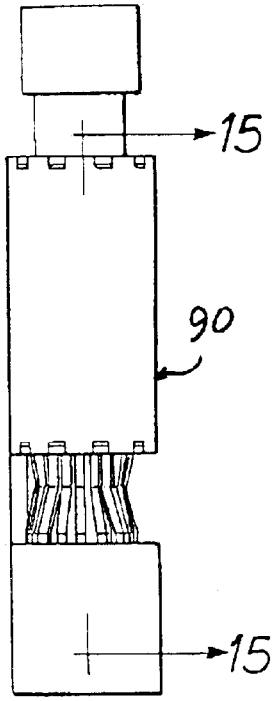
FIG. 14 is an enlarged, side elevational view of the electrical connector shown in FIG. 13 receiving an interconnecting pin.

As shown in FIG. 9, the wire crimp terminal 48 generally has a rectangular or other polygonal configuration prior to being shaped into a cylindrical form with a through bore 49 shown in FIGS. 10 and 11. The insertion of the grid 28 through the first side edge 14 of the sleeve 46 is similar to that described above for the grid 28 and sleeve 26. The cylindrical shape of the terminal 48 is suitable for receiving the exposed wire strands in an electrical conductor or cable. Once the exposed strands of the conductor or cable are inserted into the bore of the terminal 48, a suitable crimping tool is used to mechanically deform the terminal 48 into a compressed mechanical connection with the strands of the conductor or cable. A pin inserted into the sleeve 46 will thereby be electrically connected by the connector 44 to the conductor or cable connected to the wire crimp terminal 48.

Referring now to FIGS. 12–19, there is depicted an alternate grid 58, similar to grid 28, which may be employed with the sleeves 26 or 46. It will also be understood that the grid may also be mounted in an outer sleeve and secured to the outer sleeve by outer collars as disclosed in U.S. Pat. Nos. 4,657,335 and 4,734,063, or by any of the tab-to-sleeve connection methods disclosed in co-pending U.S. patent application Ser. No. 09/568,910.

The grid 58 is preferably formed of a suitable electrically conductive material, such as a beryllium copper alloy. The grid 58 is originally formed of a single sheet or blank which is stamped or otherwise formed into a sheet of suitable dimensions. Spaced, parallel, transversely extending webs 60 and 62 are formed in the blank and integrally interconnected by a plurality of contact strips 64. The strips 64 are separated from adjacent material in the blank by piercing or by other cutting or separating operations. Like the grid 28, a plurality of spaced tabs 66 and 68 project longitudinally from the webs 60 and 62, respectively. The tabs 66 and 68 and the contact strips 64 serve the same function as the corresponding tabs 36 and 38 and the contact strips 34 of the grid 28 described above and shown in FIGS. 1–8.

However, when the grid 28 is originally formed from a planar sheet or blank, the material between the spaced, parallel contact strips was punched out or otherwise separated from the blank during the formation of the contact strips 34. This results in material waste. According to a unique feature of this aspect of the invention, the grid 28 is formed with reduced material waste as the material between the spaced contact strips 64 is retained and merely separated from the contact strips 64. This material is formed into elongated contact arms 70. Each contact arm 70 is bent out of the plane of the contact strip 64 through an arcuate bend 72 which is integrally joined at one end to the web 62, for example. Each contact arm 70 may extend planarly or linearly from the end of each bend 72. In a preferred configuration shown in FIGS. 14 and 15, each contact arm 70 is formed with a first linear portion 74 extending from the end of the bend 72, a second angular, radially outward extending portion 76 and a linear end portion 78 generally at the same outer diameter as the outer diameter of the contact strips 64 when the grid 58 is formed into a cylinder as described hereafter.

When the blank used to form the grid 58 is bent into the desired cylindrical form, the tabs 66 and 68 and the contact strips 64 will assume their normal positions as described above and shown in the connector 10 depicted in FIGS. 1–8. The bend portion 72 of each contact arm 70 will extend inwardly from the outer diameter of the adjacent web 62 to place all of the contact arms 70 within the outer diameter of the contact strips 64 until the end portion 78 of each contact arm 70 is bent outwardly to the same outer diameter as the contact strips 64. The inner diameter 80 between the circumferentially-spaced bend portion 72 is less than the inner diameter of the contact strips 64. This enables an interconnecting member or pin 82, such as a SURELOK pin, for example, to be formed with a notch or undercut 84 spaced from one end 86. When the end 86 is forcibly inserted through the connector 90 including the grid 58, the end 86 will initially contact and deform the resilient bend 72 of the contact arms 70 until the end portion 86 passes the bend 72. The bend 72 will then slide into and engage the notch 84 to securely retain the pin 82 in the overall connector 90.

Figure 15:
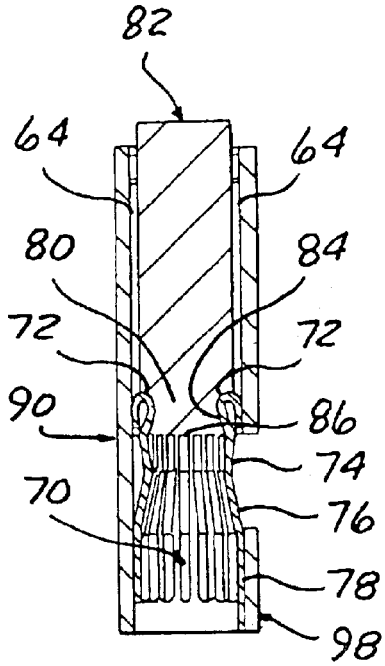
FIG. 15 is a cross sectional view generally taken along line 15—15 in FIG. 14.

Although the grid 58 may be employed in a cylindrical sleeve 26, described above and shown in FIGS. 1–8, the following depiction of the sleeve 92 will be described by example only as being similar to the sleeve 46 shown in FIGS. 9–11. Thus, the sleeve 92 includes a cylindrical portion 94 surrounding the contact strips 64, with the tabs 66 and 68 of the grid 58 securely fixed to opposed ends of the cylindrical portion 94 of the sleeve 92. An integral flange 96 extends from one end of the cylindrical portion 94 to a terminal portion 98 which is formed as a wire crimp terminal. As shown in FIG. 15, the end portions 78 of the contact arm 70 are disposed in the terminal 98 for receiving bare strands 100 of an electrical conductor or cable 102 shown in greater detail in FIGS. 18 and 19. The terminal 98 may be crimped, as described above, about the bare strands 100 of the conductor 102 to mechanically secure the conductor 102 to the connector 90.

Figure 16:
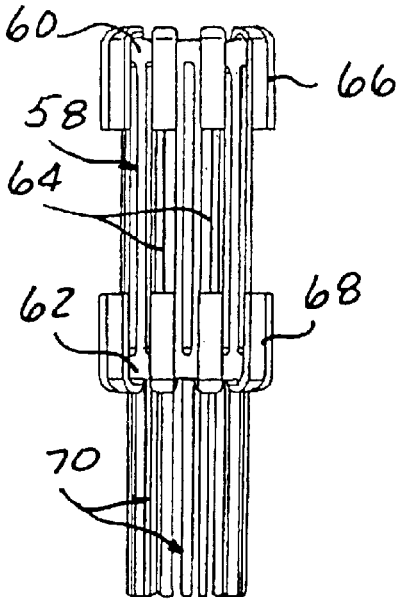
FIG. 16 is a side elevational view of the blank of FIG. 12 shown in a cylindrical shape with the end tabs bent to a sleeve engaging position.
Figure 17:
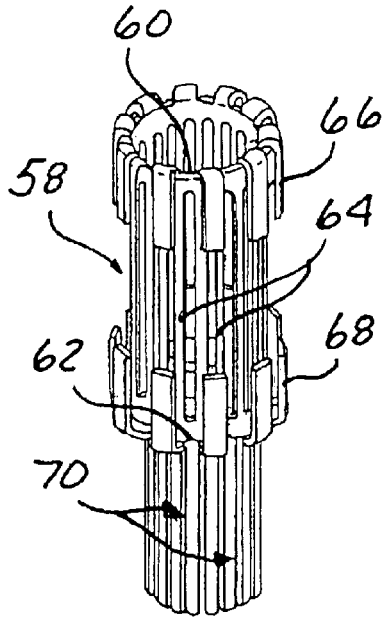
FIG. 17 is a perspective view of the blank shown in FIG. 16.
Figure 18:
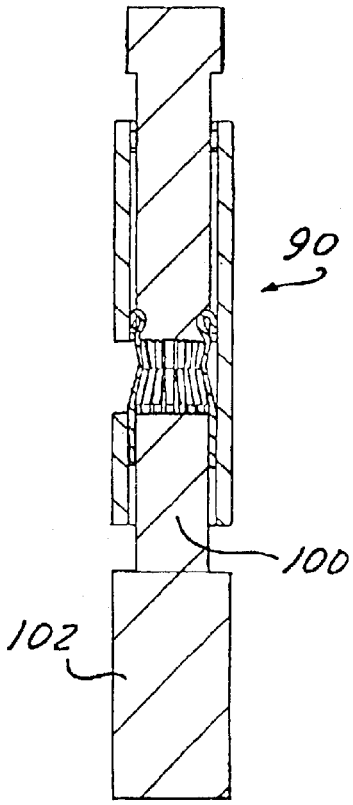
FIG. 18 is a longitudinal cross sectioned view of the connector of FIGS. 14 and 15 receiving an electrical terminal and a conductive pin.
Figure 19:
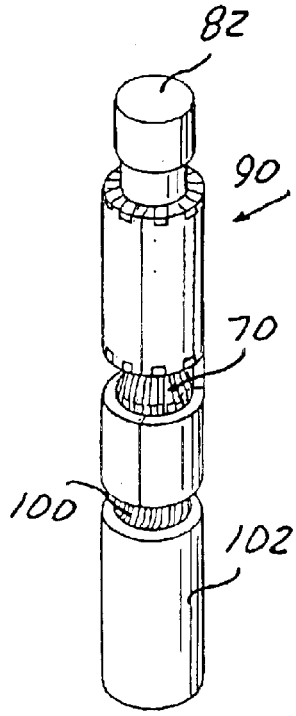
FIG. 19 is a perspective view of the connector, terminal and pin shown in FIG. 18.

FIGS. 16 and 17 depict the grid 58 after being formed into a cylindrical shape. The sleeve 92 is not depicted for reasons of clarity. FIGS. 16 and 17 depict the extension of a contact arm 70 from the tabs 58 and the integrally joined web 62.

A radially resilient electrical connector in accordance with the teachings of the present invention with the inventive grids and sleeves affords several advantages over previously devised, radially resilient electrical connectors. First, the interconnection of the interior grid with the outer sleeve is simplified. Direct joining of the tabs on the grid within alternating notches and projections formed on the ends of the sleeve eliminates the need for external collars previously employed to fixedly secure the tabs on the grid around the outer ends of the outer sleeve. In addition, the provision of contact arms formed from the material initially disposed between adjacent contact strips on the grid reduces material waste, thereby providing an enhanced electrical conductor at a lower cost. The contact arms also extend the direct current path between the interconnecting pin or conductor to the grid.

What is claimed is:

1. A method of manufacturing an electrical connector comprising the steps of forming a cylindrical sleeve with first and second ends;

forming alternating notches and projections on at least one of the first and second ends of the sleeve;

forming a cylindrical contact member with a plurality of spaced contact strips extending between first and second ends;

inserting the contact member into the sleeve with the first end of the contact member engaging the notches at the first end of the cylindrical sleeve;

circumferentially offsetting the second end of the contact member from the first end of the contact member;

engaging the offset second end of the contact member into the notches in the second end of the cylindrical sleeve;

flaring ends of the contact strips angularly outwardly to enable the second end of the contact member to engage the notches in the cylindrical sleeve during angular rotation of the second end of the contact member relative to the ends of the contact strips at the first end of the contact member; and fixing the first and second ends of the contact member to the cylindrical sleeve.

2. The method of claim 1 further comprising the step of:

bending the first end of the contact member substantially 90° with respect to an axial length of the contact member prior to insertion of the contact member into the sleeve.

3. The method of claim 1 wherein the step of fixing the first and second ends of the contact member comprises:

swaging the first and second ends of the contact member to the cylindrical sleeve.

4. The method of claim 1 wherein the step of fixing the first and second ends of the contact member further comprises the step of:

mechanically joining the first and second ends of the contact member to the cylindrical sleeve.

5. The method of claim 4 wherein the step of mechanically joining the first and second ends of the contact member comprises:

splitting at least one of the projections on the sleeve into two portions, each fixed to discrete adjacent ones of the first and second ends of the contact member.

6. The method of claim 1 wherein the step of forming alternating notches and projection further comprises the step of:

forming the notches and projections on the first end of the sleeve circumferentially offset from the corresponding notches and projections on the second end of the sleeve.

7. The method of claim 1 wherein the step of forming the alternating notches and projections further comprises the step of:

forming the notches and projections on the first end of the sleeve axially aligned with the corresponding notches and projections on the second end of the sleeve.

8. The method of claim 1 further comprising:

forming the contact member as a one-piece contact blank with the plurality of spaced contacts strips having the first and second ends;

internally joining the first and second ends of the contact strips to transversely extending, first and second parallel webs, respectively;

forming a plurality of groups of first and second tabs projecting from the first and second webs, respectively; and bending integral contact arms disposed between adjacent contact strips axially from the second tabs toward the first tabs.

9. The method of claim 8 further comprising the steps of:

inserting the contact member into the cylindrical sleeve;

forming the contact arms as a connector for receiving an external electrically conductive member.

10. The method of claim 9 further comprising the step of:

inserting an external electrical conductive member into the contact arms.

11. The method of claim 10 further comprising the steps of:

forming the cylindrical sleeve with an extension axially of the second end of the sleeve; and forming the extension as a wire grip receiving an end portion of the contact arms.

12. The method of claim 9 further including the steps of:

forming a joint of each contact arm with one of the first and second webs in a bend projecting into an interior of the sleeve;

providing a connector member for insertion through the cylindrical contact blank, the connector member having a first end; and providing a recess in the first end of the connector member for snap-in engagement with the bends of the contact arms upon insertion of the connector member into the contact member.

13. An electrical connector constructed in accordance with the method of claim 1.

14. An electrical connector comprising:

a cylindrical sleeve having first and second, opposed, axially spaced ends;

circumferentially spaced, alternating notches and projections formed in each of the first and second ends;

a contact member coaxially received in the sleeve, the contact member including a plurality of circumferentially-spaced strips, each having first and second ends, the first and second ends immovably fixed in the notches at the first and second ends of the cylindrical sleeve, respectively, with the first ends of the contact member being circumferentially offset from the second ends of the contact member; and contact arms formed between each of the contact strips and extending axially from the second end of the sleeve, the contact arms mountable in a wire crimp terminal for connecting the contact arms and the intergrally joined connector to an external electrically conductive member.

15. The electrical connector of claim 14 further comprising:

an extension projecting axially from the second end of the sleeve, the extension formed into a cylindrical wire grip for receiving an electrically conductive member therein.

16. The electrical connector of claim 14 wherein the first and second ends of the contact member comprise: first and second transversely extending webs, respectively; and a plurality of tabs extending longitudinally from each web, the tabs mountable in the notches at the first and second ends of the cylindrical sleeve.

17. The electrical connector of claim 14 further comprising:

the notches on the first end circumferentially offset from the notches in the second end; and the first ends of the contact member being circumferentially offset from the second ends of the contact member.

18. The electrical connector of claim 14 further comprising:

the notches of the first end of the sleeve axially aligned with the notches on the second end of the sleeve; and the first ends of the contact member being circumferentially offset from the second ends of the contact member.

19. A method of manufacturing an electrical connector comprising the steps of forming a cylindrical sleeve with first and second ends;

forming alternating notches and projections on at least one of the first and second ends of the sleeve;

forming a cylindrical contact member with a plurality of spaced contact strips extending between first and second ends;

inserting the contact member into the sleeve with the first end of the contact member engaging the notches at the first end of the cylindrical sleeve;

bending the first end of the contact member substantially 90° with respect to an axial length of the contact member prior to insertion of the contact member into the sleeve;

circumferentially offsetting the second end of the contact member from the first end of the contact member;

engaging the offset second end of the contact member into the notches in the second end of the cylindrical sleeve; and fixing the first and second ends of the contact member to the cylindrical sleeve.

20. The method of claim 19 wherein the step of fixing the first and second ends of the contact member comprises:

swaging the first and second ends of the contact member to the cylindrical sleeve.

21. The method of claim 19 wherein the step of fixing the first and second ends of the contact member further comprises the step of:

mechanically joining the first and second ends of the contact member to the cylindrical sleeve.

22. The method of claim 21 wherein the step of mechanically joining the first and second ends of the contact member comprises:

splitting at least one of the projections on the sleeve into two portions, each fixed to discrete adjacent ones of the first and second ends of the contact member.

23. The method of claim 19 wherein the step of forming alternating notches and projection further comprises the step of:

forming the notches and projections on the first end of the sleeve circumferentially offset from the corresponding notches and projections on the second end of the sleeve.

24. A method of manufacturing an electrical connector comprising the steps of forming a cylindrical sleeve with first and second ends;

forming alternating notches and projections on at least one of the first and second ends of the sleeve;

forming a cylindrical contact member with a plurality of spaced contact strips extending between first and second ends;

inserting the contact member into the sleeve with the first end of the contact member engaging the notches at the first end of the cylindrical sleeve;

circumferentially offsetting the second end of the contact member from the first end of the contact member;

engaging the offset second end of the contact member into the notches in the second end of the cylindrical sleeve; and fixing the first and second ends of the contact member to the cylindrical sleeve by mechanically joining them by splitting at least one of the projections on the sleeve into two portions, each fixed to discrete adjacent ones of the first and second ends of the contact member.

25. The method of claim 24 wherein the step of forming alternating notches and projection further comprises the step of:

forming the notches and projections on the first end of the sleeve circumferentially offset from the corresponding notches and projections on the second end of the sleeve.

26. The method of claim 24 wherein the step of forming the alternating notches and projections further comprises the step of:

forming the notches and projections on the first end of the sleeve axially aligned with the corresponding notches and projections on the second end of the sleeve.

27. The method of claim 24 further comprising:

forming the contact member as a one-piece contact blank with the plurality of spaced contacts strips having the first and second ends;

internally joining the first and second ends of the contact strips to transversely extending, first and second parallel webs, respectively;

forming a plurality of groups of first and second tabs projecting from the first and second webs, respectively; and bending integral contact arms disposed between adjacent contact strips axially from the second tabs toward the first tabs.

28. A method of manufacturing an electrical connector comprising the steps of forming a cylindrical sleeve with first and second ends;

forming alternating notches and projections on at least one of the first and second ends of the sleeve;

forming a cylindrical contact member with a plurality of spaced contact strips extending between first and second ends;

forming the contact member as a one-piece contact blank with the plurality of spaced contacts strips having the first and second ends;

internally joining the first and second ends of the contact strips to transversely extending, first and second parallel webs, respectively;

forming a plurality of groups of first and second tabs projecting from the first and second webs, respectively;

bending integral contact arms disposed between adjacent contact strips axially from the second tabs toward the first tabs;

inserting the contact member into the sleeve with the first end of the contact member engaging the notches at the first end of the cylindrical sleeve;

circumferentially offsetting the second end of the contact member from the first end of the contact member;

engaging the offset second end of the contact member into the notches in the second end of the cylindrical sleeve; and fixing the first and second ends of the contact member to the cylindrical sleeve.

29. The method of claim 28 further comprising the steps of:

inserting the contact member into the cylindrical sleeve;

forming the contact arms as a connector for receiving an external electrically conductive member.

30. The method of claim 29 further comprising the step of:

inserting an external electrical conductive member into the contact arms.

31. The method of claim 30 further comprising the steps of:

forming the cylindrical sleeve with an extension axially of the second end of the sleeve; and forming the extension as a wire grip receiving an end portion of the contact arms.

32. The method of claim 31 further including the steps of:

forming a joint of each contact arm with one of the first and second webs in a bend projecting into an interior of the sleeve;

providing a connector member for insertion through the cylindrical contact blank, the connector member having a first end; and providing a recess in the first end of the connector member for snap-in engagement with the bends of the contact arms upon insertion of the connector member into the contact member.

* * * * *